United States Patent [19]

Perr et al.

[11] 4,206,734

[45] Jun. 10, 1980

[54] ADJUSTABLE TIMING MECHANISM FOR FUEL INJECTION SYSTEM

[75] Inventors: Julius P. Perr; Andrew C. Rosselli, both of Columbus, Ind.

[73] Assignee: Cummins Engine Company, Inc., Columbus, Ind.

[21] Appl. No.: 864,813

[22] Filed: Dec. 27, 1977

[51] Int. Cl.[2] ..... F02M 39/00

[52] U.S. Cl. ..... 123/139 AP; 123/139 AQ; 123/139 AK

[58] Field of Search ..... 123/139 AP, 139 AQ, 123/139 AK, 55 VF, 55 VS, 55 VE, 55 V, 90.15, 90.16

[56] References Cited

U.S. PATENT DOCUMENTS

| | | | |
|---|---|---|---|
| 2,006,977 | 7/1935 | Woolson | 123/139 AP |
| 2,026,069 | 12/1935 | Schneider | 123/139 AP |
| 2,635,590 | 4/1953 | Simon | 123/139 AK |
| 2,831,433 | 4/1958 | Seifert et al. | 123/139 AK |
| 3,742,925 | 7/1973 | Gordon, Jr. et al. | 123/139 AP |

FOREIGN PATENT DOCUMENTS

| | | | |
|---|---|---|---|
| 434409 | 4/1948 | Italy | 123/55 V |
| 412136 | 6/1934 | United Kingdom | 123/139 AQ |

*Primary Examiner*—Charles J. Myhre

*Assistant Examiner*—Andrew M. Dolinar

*Attorney, Agent, or Firm*—Merriam, Marshall & Bicknell

[57] ABSTRACT

This disclosure deals with apparatus for adjusting the timing of injection in an internal combustion engine wherein the fuel system includes unit injectors. The injector for each combustion chamber of the engine is actuated to inject fuel by a cam-follower-linkage mechanism that operates in time relation with the movement of the pistons of the engine. Each such mechanism includes a cam which is rotated in synchronism with the pistons of the engine, a pivotable cam follower which rides on the cam, and a linkage which connects the follower with an injector. The injector includes a plunger which seats on a cup or nozzle to terminate injection. To adjust the timing of injection, the pivot point of the follower and the angular point of engagement of the follower with the cam are moved. The relation of the cam, the follower and the linkage are arranged such that the movement of the linkage does not materially change the effective travel of the plunger as the timing is changed within a broad range. Consequently, the compression load on the plunger and the injector nozzle remains substantially constant at the termination of injection regardless of changes of the timing.

9 Claims, 15 Drawing Figures

114
116
113
117
118
107
112
119
109
120
106
111
108
121
122
133
134
139
126
127
132
138
136
123
141
163
131

176
174
169
177
168
189
187
178
187
171
106
173
167
172
164
186
163
166
162
187
156
124
161
158
159
162
163
159
161
157
147
106
126
122
10
10
132
146
123

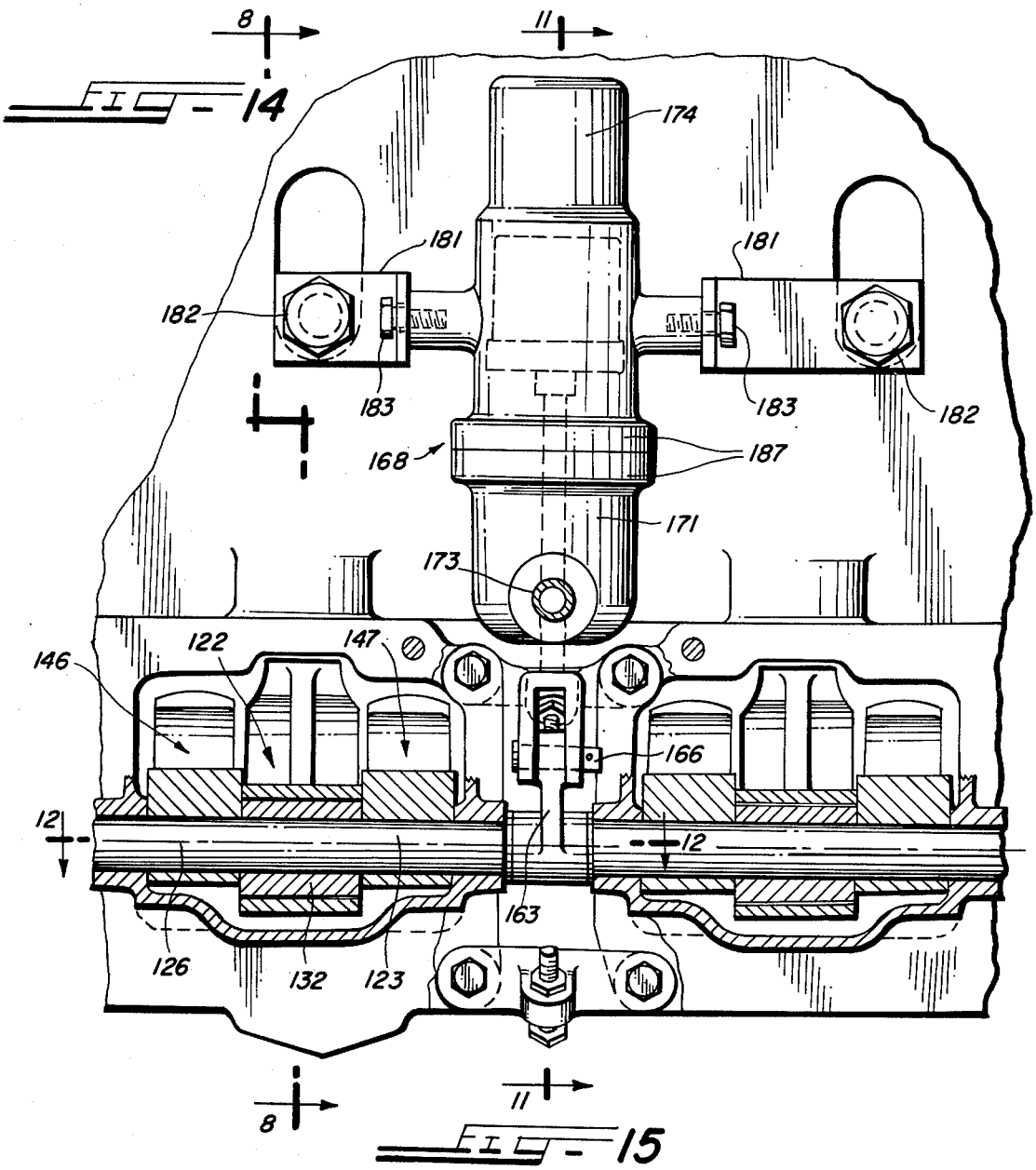
FIG-15
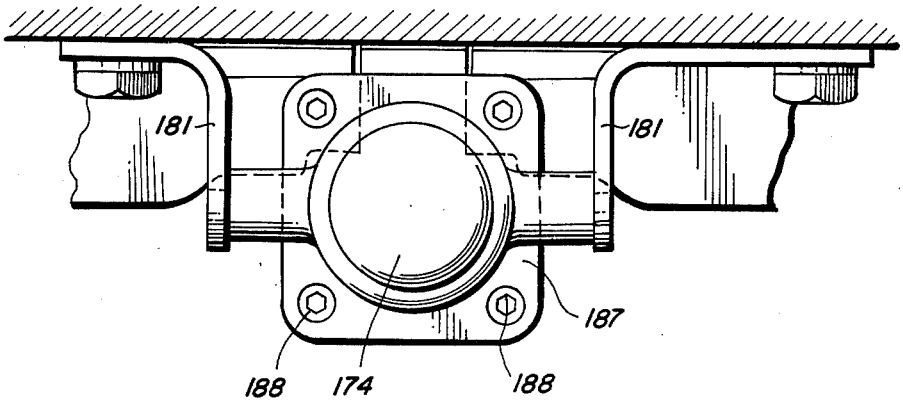

ADJUSTABLE TIMING MECHANISM FOR FUEL INJECTION SYSTEM

Internal combustion engines including injectors for spraying fuel directly into combustion chambers of the engine are of course in common use. The diesel engine is a well known example. In one type of fuel supply stream system for such an engine, a unit injector is actuated to inject fuel at the appropriate time in each operating cycle by a cam follower and linkage mechanism that is operated off of a cam shaft of the engine. The cam shaft of course turns in synchronism with the engine crank shaft and the other operating parts of the engine.

In such an engine it is advantageous to be able to adjust the timing of injection relative to the positions of the pistons during operation of the engine. In one type of fuel injection system, a timing change is attained by making an adjustment in the phase relation of a high pressure fuel distributor relative to the engine, and in another type such an adjustment is made by mechanisms in the injectors. Such arrangements are expensive however. In systems including unit injectors, it is difficult to make identical adjustments for all injectors of a large engine. Other arrangements for adjusting the timing of injection are shown in U.S. Pat. Nos. 1,265,799, 2,484,926, 3,040,723 and 3,138,038. U.S. Pat. No. 2,936,575 shows a related arrangement for adjusting the timing of operation of engine valves. In such arrangements a cam follower is provided in the drive train between the cam and the injector, and the position of the follower relative to the cam is adjusted to obtain a change in the timing. A disadvantage of such prior art arrangements is that such an adjustment results in an excessive change in the effective length of the linkage between the cam shaft and the injector, which can result in damage to the injector. For proper operation of a high pressure injector, a change in the length of the linkage, greater than 0.001 inch is unacceptable. Further, in some such devices a timing change cannot be made during operation of the engine.

It is therefore a general object of the present invention to provide improved apparatus for adjusting the timing of injection of a plurality of injectors of an engine, which is free of the foregoing disadvantages.

Apparatus in accordance with the present invention is designed for use in an engine including at least one injector, a rocker arm engaging the injector, and at least one rotatable cam shaft. A cam having a lobe thereon is formed on the cam shaft, and a cam follower contacts the cam at a point of contact on the cam. An elongated link has one end thereof engaging the cam follower and the other end engaging the rocker arm. Means is provided to support the cam follower for pivotal movement on a pivot axis. Eccentric means is provided for shifting the pivot axis so as to effect a change in the contact point and thereby change the timing, and for moving said one end of said link substantially along an arc which has said other end of said link as its center. By maintaining said one end of the link substantially on the arc during a timing adjustment, there is a minimal change in the effective length of the link.

Further objects and advantages of the present invention will become apparent from the following detailed description taken in conjunction with the accompanying figures of the drawings, wherein:

FIG. 14 is a fragmentary sectional view of a portion of the apparatus illustrated in FIG. 11; and FIG. 15 is an elevational view of the structure shown in FIG. 14.

While the invention is illustrated and described in connection with a V-type and an in-line type reciprocating piston engines, it should be understood that the invention may also be used in other types of engines, such as rotary engines.

Figure 1:
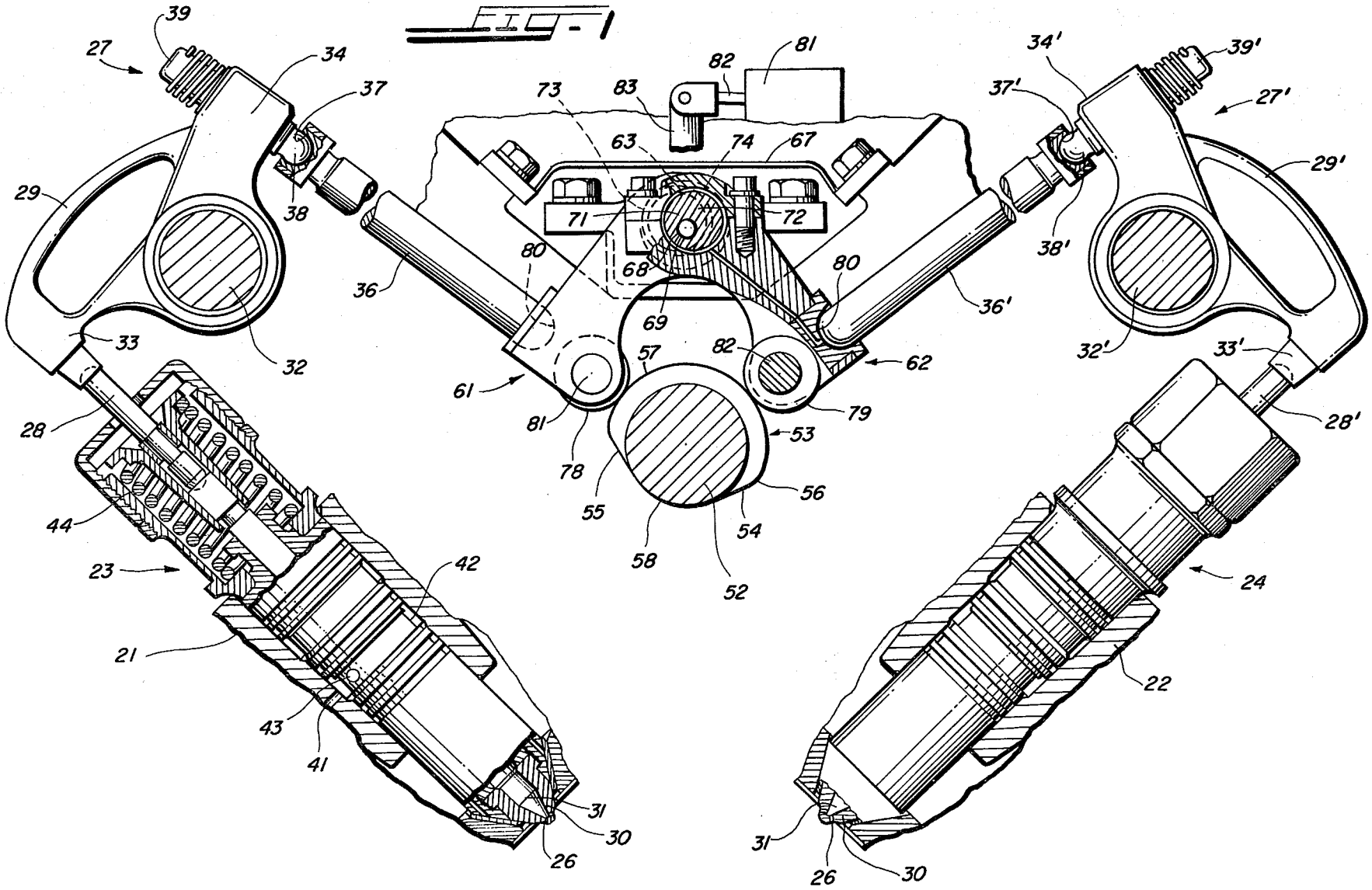
FIG. 1 is an illustration partially in section of part of a V-type engine including apparatus embodying the invention.

With reference to the drawings, FIG. 1 illustrates a portion of a V-type engine including two heads 21 and 22 which respectively support two injectors 23 and 24. As is well known in the art, an injector is provided for each combustion chamber of the engine, and while only two injectors are shown in FIG. 1, an engine normally includes a larger number of cylinders and injectors.

Spray holes 26 are formed in the lower end of each injector, which end projects into the upper end of a combustion chamber, and at the optimum time in the cycle of the engine, a fine spray or mist of fuel is ejected through the holes 26, the fuel then being burned within the combustion chambers.

The injector 23 is connected to a cam actuated linkage mechanism, indicated generally by the numeral 27, to be operated in timed relation with the other parts of the engine. The linkage mechanism 27 includes a connecting link 28 that extends between a rocker arm 29 and the upper end of a plunger 31 which forms part of each injector. The rocker arm 29 is pivotally mounted on a stationery rocker shaft 32, and one end 33 of the arm 20 engages the link 28 and the other end 34 engages the upper end of a pusher rod or link 36. The pusher rod 36 has a spherical socket or cavity 37 formed in its upper end, and a ball 38 secured to the end 34 of the rocker arm 29 is seated in the socket 37. The ball 38 is connected by a tension adjusting mechanism 39 to the end 34 of the rocker arm 29.

The injector 24 is actuated by a similar linkage mechanism 27, the parts of which are given the same reference numerals as the parts of the mechanism 27 but the numbers are primed.

Each of the injectors 23 and 24 is operated by moving the plunger in an injection stroke, to inject fuel into the associated combustion chamber at the appropriate time in each cycle of the engine. In the positions of the two plungers 31 illustrated in FIG. 1, the plungers have completed an injection stroke and are at their lowermost positions where they close the spray holes 26. As the engine cycle continues, the plunger 31 of the injector 23, for example, will move upwardly and fuel from a fuel supply system flows through a passage 41 formed in the engine block 21, into an annular groove 42 formed in the injector 23, through an inlet passageway 43 formed in the body of the injector 23, and into a fuel injection chamber (not illustrated) within the injector 23. After an amount of fuel has been metered into the injector 23, the injector is operated, as the associated piston is approaching top dead center, to inject fuel into the engine cylinder. This is accomplished by pivotal movement of the rocker arm 29 in the counterclockwise direction as seen in FIG. 1 in order to force the link 28 and the plunger 31 downwardly and toward the right. Injection is terminated when the plunger 31 engages the injector cup or nozzle 30 and closes the flow passage to the spray holes 26 which are formed in the nozzle 30. The unit injectors disclosed herein are of the character disclosed in detail in U.S. Pat. No. 3,351,288. The plunger 31 normally remains in the lowermost position in tight engagement with the nozzle 30 through the power or combustion stroke of the piston. Thereafter, the rocker arm 29 turns in the clockwise direction which enables a return spring 44 of the injector 23 to move the plunger 31 and the link 28 upwardly and the rocker arm 29 to move in the clockwise direction.

The injector 24 and the other injectors of the engine operate in a similar manner but, of course, they inject fuel at different times in each cycle of the engine.

In the operation of a compression ignition engine, such as a diesel engine, it is important to initiate injection of the fuel into the combustion chamber at the optimum time in the cycle of movement of the piston, and it is further important to terminate injection at an optimum time. The optimum times at which initiation and termination of injection occur varies with different operating conditions of the engine. For example, the optimum time for initiation of injection may be different when the engine is idling than when it is operating at cruising or at high speeds. It is therefore advantageous to be able to adjust the timing of initiation and termination of injection during the operation of the engine. It is further important that, when such a timing adjustment is made, the length of the injection stroke and the location of the plunger 31 when the injection force is terminated, be held to less than .001 inch. If the force is not terminated when the lower end of the plunger reaches the nozzle or cup of the injector, the injector can be damaged. When the plunger moves down and engages the injector nozzle 30 to terminate injection, the entire drive train, including the link 28 and the push rod 36, is under compression. A small volume of fuel is also trapped in the injector between the plunger and the nozzle, and this trapped volume is also under compression. If this compression is too great, the nozzle 30 may be soon damaged, but if the compression is not enough, the plunger may rebound and permit some of the trapped volume to leak out of the holes 26. In the latter instance, fuel consumption and pollution is increased. It is therefore very important that the compressive load be substantially constant in spite of changes in the timing, and this is accomplished by structure in accordance with this invention.

The structure 51 comprises a cam shaft 52 (FIG. 1) which is connected to be driven in timed relation with the crank shaft (not shown) of the engine. The construction of the cam shaft 52 and its connection to the crankshaft is in accordance with wellknown principles. The cam shaft 52 has a plurality of cams 53 formed thereon (only one cam 53 being shown in FIG. 1), and one such cam 53 is provided for each injector of the engine. While the cams 53 all have the same profile, they are axially and angularly displaced relative to each other on the shaft 52. The profile of each of the cams 53 includes an ascending ramp 54, a hump 56 at the top of the ram 54, a lobe or arcuate raised portion 57, a descending ramp 55, and a lower portion 58. As shown in FIG. 1, the lobe 57 has a slightly smaller radius than the hump 56.

The mechanism 51 further comprises a cam follower 61 for the injector 23 and a cam follower 62 for the injector 24. The cam followers 61 and 62 are identical and are pivotally mounted in axially spaced relation on a rocker shaft 63 (FIGS. 1 to 5), and each of the cam followers 61 and 62 engages a different cam 53. While the two cam followers 61 and 62 appear, in FIG. 1, to be engaging the same cam 53, actually the cam follower 62 is spaced toward the direction of the viewer from the cam follower 61, and the two cam followers engage different cams 53.

Figure 2:
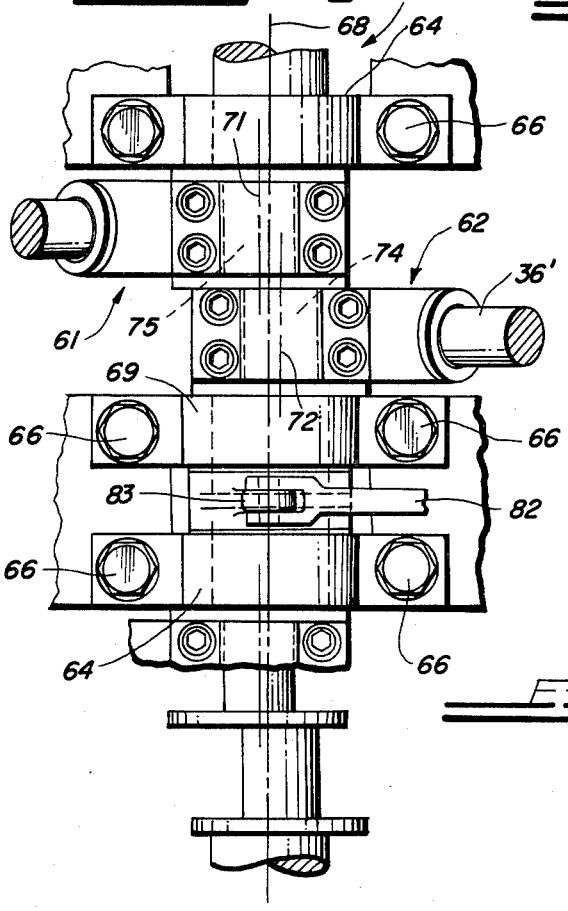
FIG. 2 is a fragmentary plan view of a portion of the apparatus illustrated in FIG. 1.

With reference to FIG. 2, the rocker shaft 63 is supported by bearings 64 which are spaced at suitable distances along the length of the shaft 63. The bearings 64 are fastened by screws 66 to the engine and support the shaft 63 in the space between the two banks of the cylinders, and a cover 67 (FIG. 1) is preferably provided over the shaft 63. With reference to FIG. 1, the shaft 63 is rotatable in the bearings 64 about its axis which is indicated by the reference numeral 68. A passage 69 may be formed down the center of the shaft 68 and form parts of a lubricant system of the engine.

The cam followers 61 and 62 are pivotally mounted on eccentric portions of the shaft 63 and axes of which are offset from the axis 68. The pivotal axis of the cam follower 61 and the axis of the associated eccentric portion 73 is indicated by the reference numeral 71, and the pivotal axis of the cam follower 62 and the axis of the associated eccentric portion 74 is indicated by the reference numeral 72, and it will be noted from FIG. 1 that the axis 71 and 72 are offset on opposite sides of the axis 68.

Figure 3:
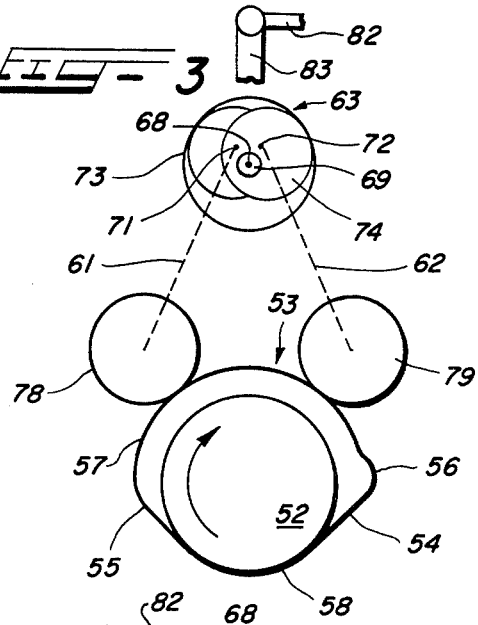
FIGS. 3 to 5 are schematic drawings illustrating the operation of the apparatus.
Figure 4:
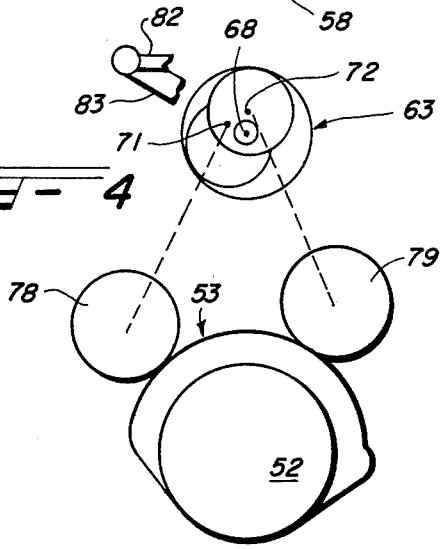
Figure 5:
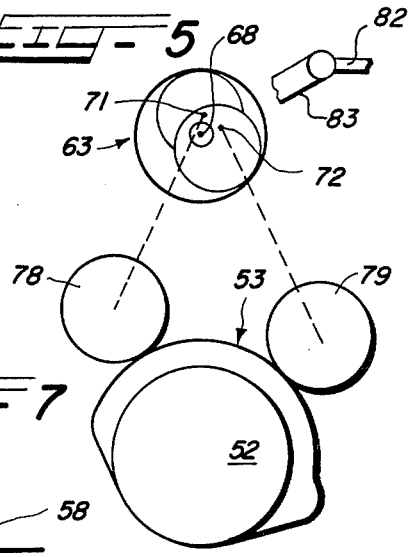

FIGS. 3 to 5 of the drawings also illustrate schematically the shaft 63, the eccentric portions 73 and 74, and the various axes mentioned above. From the eccentric portions 73 and 74, the two cam followers 61 and 62 angle downwardly and laterally, and adjacent their lower ends are fastened cam follower rollers 78 and 79. The rollers 78 and 79 are fastened by pins 81 and 82 (FIG. 1) to the undersides of the cam followers 61 and 62, and the lower ends of the push rods 36 and 36' are received in sockets 80 formed in the upper sides of the cam followers.

Due to the fact that the axes 71 and 72 of pivotal movement of the eccentric portions 73 and 74 and the two cam followers 61 and 62 are offset from or eccentric relative to the axis 68 of the shaft 63, the positions of the two cam followers 61 and 62 relative to the cam 53 may be adjusted or varied by turning the shaft 63, as illustrated in FIGS. 3, 4 and 5. These three figures illustrate the fact that the time of initiation and termination of injection relative to the position of the associated piston may be adjusted by shifting the position of the two cam followers. With reference to FIG. 3, it will be noted that the axes 71 and 72 are spaced substantially equal distances on opposite sides of a vertical line passing through the axis of the cam shaft 52 and the axis 68 of the rocker shaft 63. The position of the parts shown in FIG. 3 illustrates an intermediate setting of timing. The cam shaft 52 and the cam 53 rotate in the clockwise direction as seen in FIGS. 1, 3, 4 and 5, and when the ramp 54 of the cam 53 meets the follower roller 78, it forces the roller 78 to swing upwardly, about the axis 71, in the clockwise direction as seen in FIGS. 1 and 3. Such swinging or pivotal movement of the roller 78 causes the cam follower 61 and the lower end of the push rod 36 to swing upwardly and toward the left as seen in FIG. 1, resulting in pivotal movement of the rocker arm 29 in the counterclockwise direction and downward movement of the plunger 31 of the injector 23 in an injection stroke. Injection continues until the top of the hump 56 of the cam 53 passes under the roller 78, at which time the plunger of the injector 23 is at its lowermost position. After the hump 56 passes, the lobe 57 of the cam 53 moves under the roller 78 and holds the plunger in its lowermost position. With continued rotation of the cam 52, the ramp 55 of the cam 53 passes under the roller 78, thereby enabling the return spring 44 of the injector 24 to move the parts clockwise and to return the roller 78 to the lower portion 58 of the cam 53.

To advance the timing of injection, the cam follower 61 and the roller 78 are shifted in the counterclockwise direction as seen in FIGS. 1, 3, 4 and 5 or against the direction of rotation of the cam 53. This is accomplished by turning the rocker shaft 63 on its axis 68, thereby causing the axis 71 of the cam follower 61 to swing arcuately downwardly and toward the left from the position illustrated in FIG. 3 to the position illustrated in FIG. 4. The result of this movement is that the roller 78 is angularly displaced relative to the cam 53, with the result that the ramp 54 of the cam 53 engages the roller 78 at an earlier time in the engine's cycle than is the case when the parts are in the positions illustrated in FIG. 3.

Since the cam follower 62 is also mounted eccentrically on the rocker shaft 63 but on the opposite side of the axis 68, the axis 72 of pivotal movement of the follower 62 swings upwardly and to the left from the position illustrated in FIG. 3 to the position illustrated in FIG. 4. Thus, the cam follower 62 and the roller 79 are also angularly displaced in the counter-clockwise direction relative to the cam 53. Further, since the two axes 71 and 72 are symmetrically located on opposite sides of the axis 68, the amount of the angular displacement of the rollers 79 and 78, relative to the cam 53 will be equal. Therefore, both the injector 23 and the injector 24 will have their timing of initiation, and also of termination, of injection advanced at the same time and by equal amounts.

To retard the timing of initiation and termination of injection, the rocker shaft 63 is turned in the clockwise direction to swing the axes 71 and 72 in the clockwise direction about the axis 68. Both of the cam followers 61 and 62 and the rollers 78 and 79 fastened thereto also move in the clockwise direction relative to the cam 53 to the position illustrated in FIG. 5. Further, the amount of the angular displacement on the cam 53 will be the same and the initiation and timing of injection of the two injectors 23 and 24 will be retarded by equal amounts.

So that the timing may be automatically adjusted, an actuator 81 (FIG. 1) is connected to rotate the rocker shaft 63. The construction and operation of a suitable mechanism such as the mechanism 81 will be described hereinafter in connection with the form of the invention shown in FIGS. 7 through 15. The actuator 81 is connected by a link 82 to an arm 83 which is secured to and extends generally upwardly from the shaft 63 (FIGS. 1 and 2). During operation of the actuator 81, the link 82 is moved toward the right or left as seen in FIG. 1, thereby causing the arm 83 to turn the shaft 63. As will be described hereinafter, the actuator 81 may be connected to respond to one or more operating parameters of the engine in order to automatically adjust the timing during operation of the engine.

As previously mentioned, apparatus in accordance with the invention is designed to accomplish the foregoing adjustments in timing without materially changing the effective length of the push rod, which is the distance from the cam 53 to the rocker arms 29 and 29', and this feature will be discussed in detail hereinafter.

Figure 6:
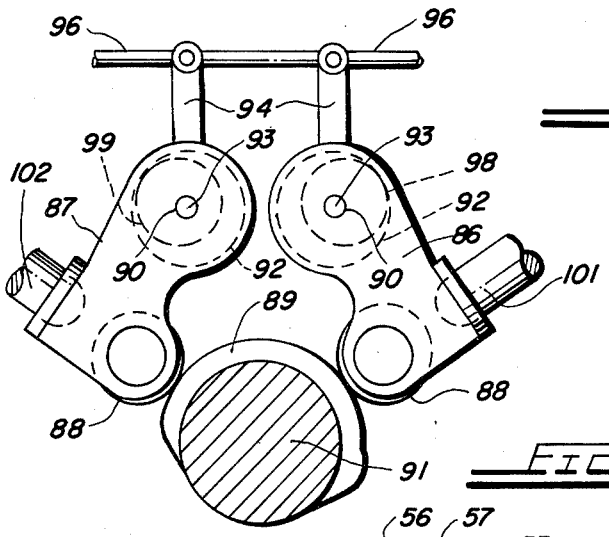
FIG. 6 is a fragmentary view similar to FIG. 1 but illustrating an alternate form of the invention.

The apparatus illustrated in FIG. 6 operates generally similarly to the structure illustrated in FIGS. 1 through 5, the principal difference being that the two cam followers are mounted on separate rocker shafts rather than on the same shaft. The apparatus illustrated in FIG. 6 comprises two cam followers 86 and 87, each follower including a follower roller 88. The rollers 88 engage the outer surfaces of two separate cams, only one cam 89 being shown in FIG. 6. The cams 89 are formed on a cam shaft 91, the shaft 91 and the cams 89 being similar to the cam shaft 52 and the cam 53 illustrated in FIGS. 1 through 5. The cam followers 86 and 87 are pivotally mounted on separate rocker shafts 92 which are rotatable on axes 93. An arm 94 and a linkage 96 corresponding to the arm 83 and linkage 82 are connected to turn each of the shafts 92.

The two followers 86 and 87 are pivotally mounted on eccentric portions 98 and 99 which are eccentric relative to the axes 93 of the two rockers shafts 92. The axis 90 of pivotal movement of the follower 86, is offset toward the right and upwardly from the axis 93 of the shaft 92, and the follower 86 will be angularly displaced relative to the cam 89 when the axis 90 swings around the axis 93. Similarly, the axis 90 of the eccentric portion 99 is offset upwardly and toward the left from the axis 93. In order to adjust the timing, the arms 94 secured to the two rocker shafts 92 are turned simultaneously to angularly displace the followers 86 and 87 relative to the cam 89.

Figure 7:
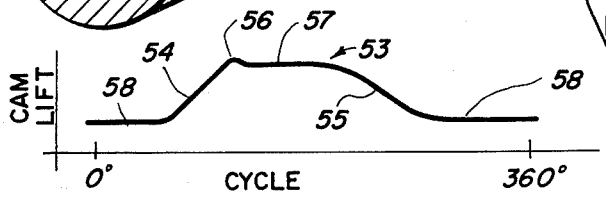
FIG. 7 is a curve illustrating a cam profile of the apparatus.

FIG. 7 illustrates a layout of the cam 53. The same reference numerals used in FIGS. 1 to 5 are also used in FIG. 7.

Figures 8, 9, 10:
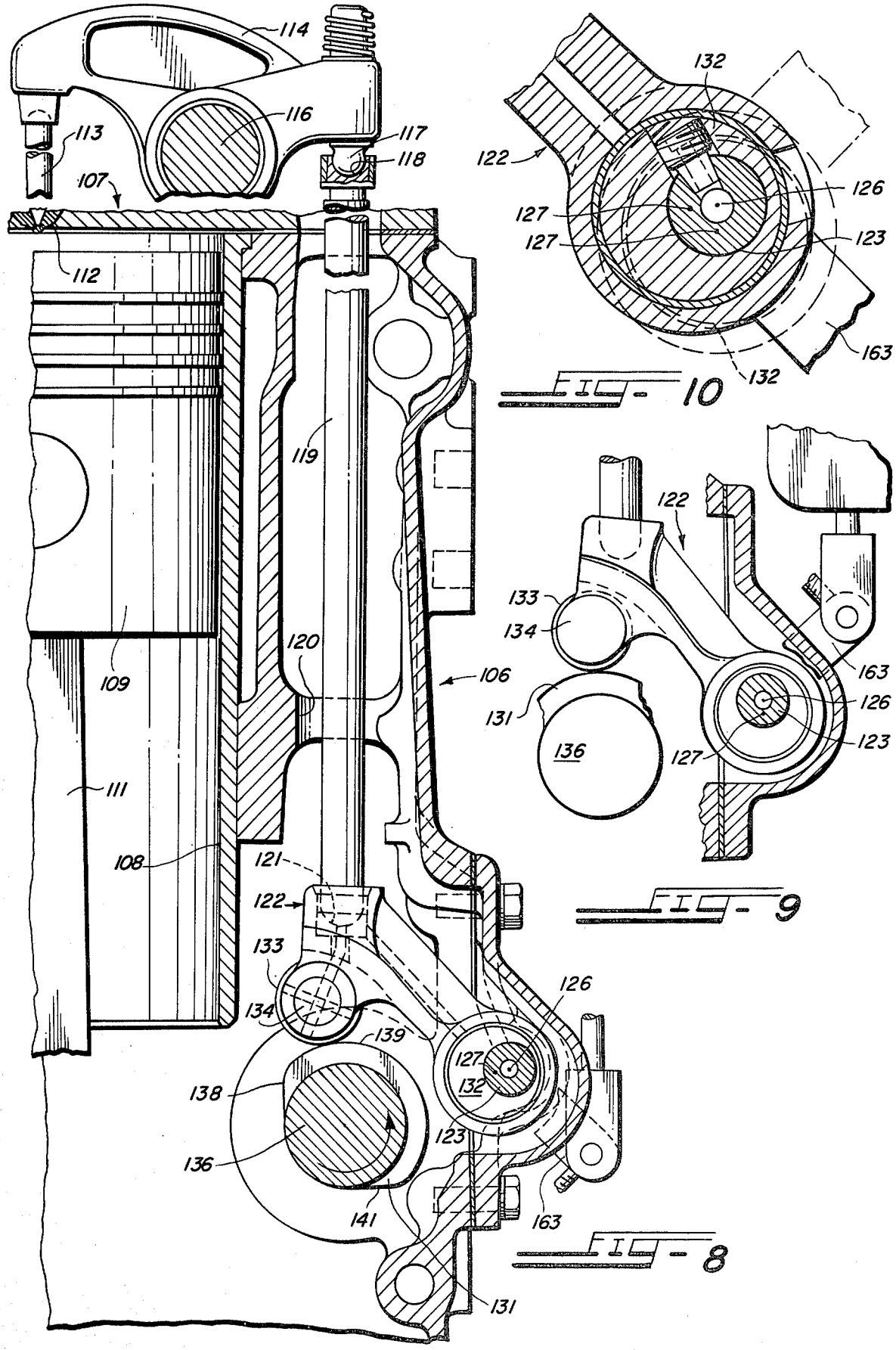
FIG. 8 is a fragmentary sectional view taken on the line 8—8 of FIG. 14, of an in-line type engine including apparatus embodying the invention.
FIG. 9 is a view of a portion of the apparatus shown in FIG. 8 but illustrating a different position of some of the parts.
FIG. 10 is a fragmentary enlarged section view taken on the line 10—10 of FIG. 12.

While the forms of the invention illustrated in FIGS. 1 through 6 are for use in a V-type engine, the construction shown in, FIGS. 8 through 15, which is the preferred form of the invention, illustrates the invention as applied to an in-line engine. With specific reference to FIGS. 8, 12 and 14, the engine includes a block 106, a head 107, a cylinder liner 108, and a piston 109 reciprocably mounted in the cylinder liner 108. A connecting rod 111 is connected to the piston 109 and to a crank shaft (not shown) which is at the lower end of the rod 111. An injector 112 is mounted in the head 107 at the upper end of the cylinder liner 108, and a connecting link 113 extends from a rocker arm 114 to a plunger of the injector 112. The arrangement of the injector 112, the link 113 and the rocker arm 114 may be generally the same as in the construction shown in FIG. 1. The rocker arm 114 is pivotally mounted on a rocker shaft 116 and has its outer end connected to a ball 117. The ball 117 is received in a socket 118 fastened to the upper end of a push rod or link 119, the lower end of the push rod 119 being seated in a socket 121 formed on the upper side of a cam follower 122. As best illustrated in FIG. 8, the push rod 119 extends generally vertically through a passage 120 formed in the engine block 106.

Figures 11, 12:
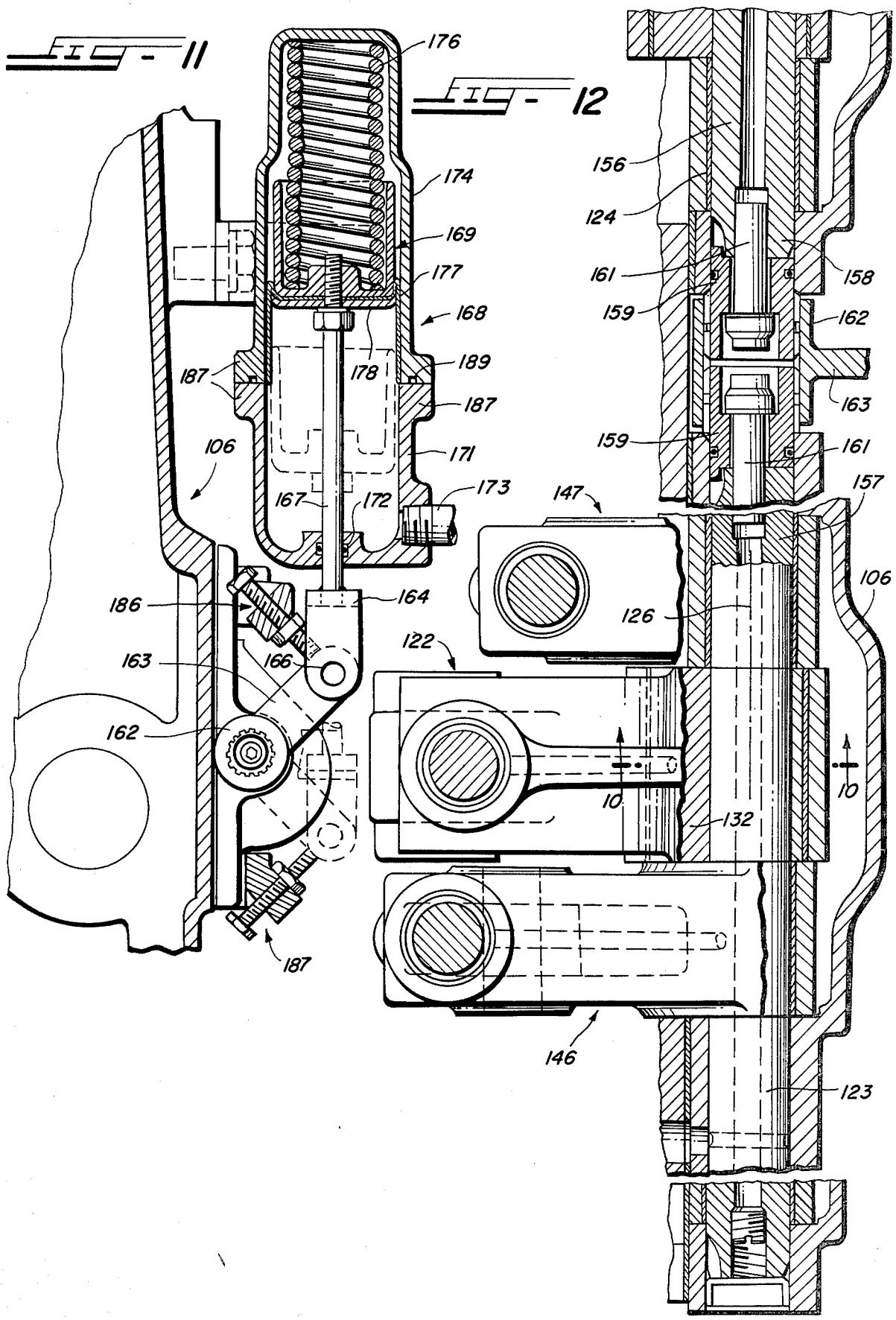
FIG. 11 is a fragmentary sectional view taken on the line 11—11 of FIG. 14.
FIG. 12 is a fragmentary sectional view taken on the line 12—12 of FIG. 14.

The cam follower 122 is pivotally mounted on a rocker shaft 123 which is supported on the engine block 106 (FIGS. 12 and 14). With reference to FIG. 8, 9 and 10, the axis of the rocker shaft 123 is indicated by the reference numeral 126 and the axis of the eccentric portion 132 of the shaft 123, on which the cam follower 122 is mounted is indicated by the reference numeral 127. It will be noted that the axis 127 is offset from or eccentric relative to the axis 126 of the shaft 123, and consequently when the rocker shaft 123 is turned on its axis 126, the axis 127 of the eccentric portion 132 and the cam follower swings about the axis 126. In the position of the axis 127 illustrated in FIG. 8, the cam follower 122 is in the maximum retard position, and in the position of the axis 127 shown in FIG. 9, the cam follower 122 is in the maximum advance position. These two positions of the axis 127 are also illustrated in FIG. 10, the solid lines representing the maximum retard position and the dash-lines representing the maximum advance position.

The cam follower 122 includes a follower roller 133 which is rotatably mounted by a pin 134 adjacent the outer end of the follower 122, and the roller 133 rides on the outer surface of a cam 131. The cam 131 is formed on a cam shaft 136 of the engine and, upon rotation of the cam shaft 136 in the counterclockwise direction during operation of the engine, the cam 131 causes the roller 133 to move upwardly and the cam follower 122 to swing in the clockwise direction as seen in FIG. 8 at the appropriate time for injection. Injection occurs when an ascending ramp 138 of the cam 131 moves under the roller 133 and forces it upwardly. A raised portion or lobe 139 of the cam 131 holds the follower upwardly until a downwardly sloped ramp 141 of the cam 131 moves under the cam follower 133 and enables a retraction spring (not illustrated in FIG. 8) to move the follower downwardly.

In addition to the cam actuated mechanism and the linkages for actuating the plungers, the shaft 123 further supports cam followers for actuating the intake and exhaust valves (not illustrated) of the cylinder 108. Two of these cam followers are indicated by the reference numerals 146 and 147 in FIG. 12. The axis of the followers 146 and 147 coincides with the axis 126 of the rocker shaft 123. Consequently, any rotational movement of the rocker shaft 123 will not change the axis of pivotal movement of the followers 146 and 147, and the shaft 123 may be turned in order to adjust the timing of injection without changing the timing of opening and closing of the valves.

With particular reference to FIG. 12, each cylinder of the engine has associated therewith one cam follower 122 for an injector and two cam followers 146 and 147 for the intake and the exhaust valves. The rocker shaft has as many sets of cam followers 122, 146 and 147 mounted thereon as there are engine cylinders. A second rocker shaft 156 (FIGS. 12 and 14) similar to the shaft 123, is mounted in an in-line, end-to-end relation with the shaft 123 and the adjacent ends 157 and 158 are secured to splined members 159, threaded members 161 being employed to secure the splined members 159 to the ends of the shafts 123 and 156. An internally splined coupling 162 bridges or extends between the two members 159 and connects them together.

The coupling 162 is also part of a timing adjustment mechanism for turning the two shafts 123 and 156. An actuating arm 163 (FIGS. 11, 12 and 14) is formed on one side of the coupling 162 and extends outwardly away from the engine block 106. The lower end of a yoke or 164 is connected by a pin 166 to the outer end of the arm 163, the yoke 164 being connected between the arm 163 and a rod 167 of an actuator 168. The rod 167 is secured to a piston 169 which is movably mounted in a cylinder 171. A seal 172 is positioned around the opening for the rod 167. A tube 173 is coupled to the interior of the cylinder 171 on the lower side of the piston 169, and the tube 172 may be connected, for example, to the engine air intake manifold, with the result that the air pressure within the lower part of the cylinder 171 on the underside of the piston 169 corresponds to the intake manifold pressure. Attached to the upper side of the cylinder 171 is a bonnet 174 which houses a compression spring 176. The spring 176 extends between the upper side of the piston 169 and the top wall of the bonnet 174, and urges the piston 169 downwardly against the force of the air pressure within the cylinder 171. A flexible diaphram 177 is fastened to the underside of the piston 169 by a plate 178 and by the threaded upper end of the rod 167 and the outer edge of the diaphram is secured at the connection between the bonnet 174 and the cylinder 177. As shown in FIGS. 14 and 15, the bonnet 174 and the cylinder 171 have radially outwardly extending flanges 187 at their adjacent faces, and screws 188 are employed to secure the flanges 187 together. An O-ring seal 189 (FIG. 11) is provided to seal the connection of the flanges 87.

With reference to FIGS. 14 and 15 the actuator 168 is supported on the side of the engine block by suitable angles 181, by bolts 182 which secure the angles 181 to the block, and by screws 183 which secure the angles 181 to the sides of the actuator bonnet 174.

It should also be noted that numerous passages for a lubricating medium are formed in the various rocker shafts, cam shafts, cam followers and other mechanisms. Since the construction and arrangement of these lubricant passages are not essential to an understanding of the present invention and are conventional in nature, they have not been discussed in detail.

Considering the operation of the structure illustrated in FIGS. 8 through 15 during operation of the engine, if the pressure is low within the portion of the cylinder 171 which is below the piston 169, the spring 176 is able to move the piston 169 downwardly to the dashed line position shown in FIG. 11. This downward movement causes the arm 163 to swing to the retard position illustrated in dashed lines in FIG. 11 and to the position illustrated in FIG. 8. The connections between the parts must be loose enough to enable the pin 166 to swing in an arc as the arm 163 pivots.

With reference to FIG. 8, when the arm 163 is pivoted to the retard position, it turns the rocker shafts 123 and 156 in the clockwise direction and the axis 127 of pivotal movement of the rocker arm 122 swings upwardly and toward the left. This movement of the axis 127 shifts the cam follower 122, relative to the cam 131, to its retard or maximum counterclockwise portion. Since the cam 131 rotates in the counterclockwise direction as seen in FIG. 8, the ramp 138 will engage the follower roller 133 relatively late in the cycle of the associated cylinder, thereby retarding the timing of initiation, and also of termination, of injection. If the air pressure rises and moves the piston 169 upwardly toward the full advance position, the resulting movement of the arm 163 turns the rocker shaft 123 and thereby swings the axis 127 downwardly and toward the right (FIG. 9). The follower 122 is of course moved clockwise on the cam 131 and the timing is advanced.

The maximum extent of upward movement of the arm 163 is limited by a stop screw and nut arrangement 186 (FIG. 11). A similar stop screw and nut arrangement 187 is also provided to limit the extent of pivotal movement of the arm 163 toward the retard position. As the engine operating conditions change, the piston 169 automatically moves and adjusts the timing. Of course, the timing of all of the fuel injectors on the shafts 123 and 156 will be adjusted simultaneously and by equal amounts.

The following comments apply to all of the forms of the invention. As previously mentioned, it is important to be able to adjust the timing during the operation of the engine, and this is readily accomplished using apparatus in accordance with this invention. Further, the timing may be adjusted automatically during engine operation in response to an engine operating parameter of the invention, and the timing of all injectors is adjusted simultaneously and by equal amounts.

More importantly, when a timing adjustment is made, it does not result in a material change in the compressive load of the injector plunger on the nozzle. As previously mentioned, an increase in the load would damage the nozzle whereas a decrease in the load would permit fuel dribbling and/or secondary injection. In accordance with this invention, after the amount of the load has initially been adjusted during assembly of the engine, the amount of the load will not change substantially despite automatic timing changes during engine operation.

Figure 13:
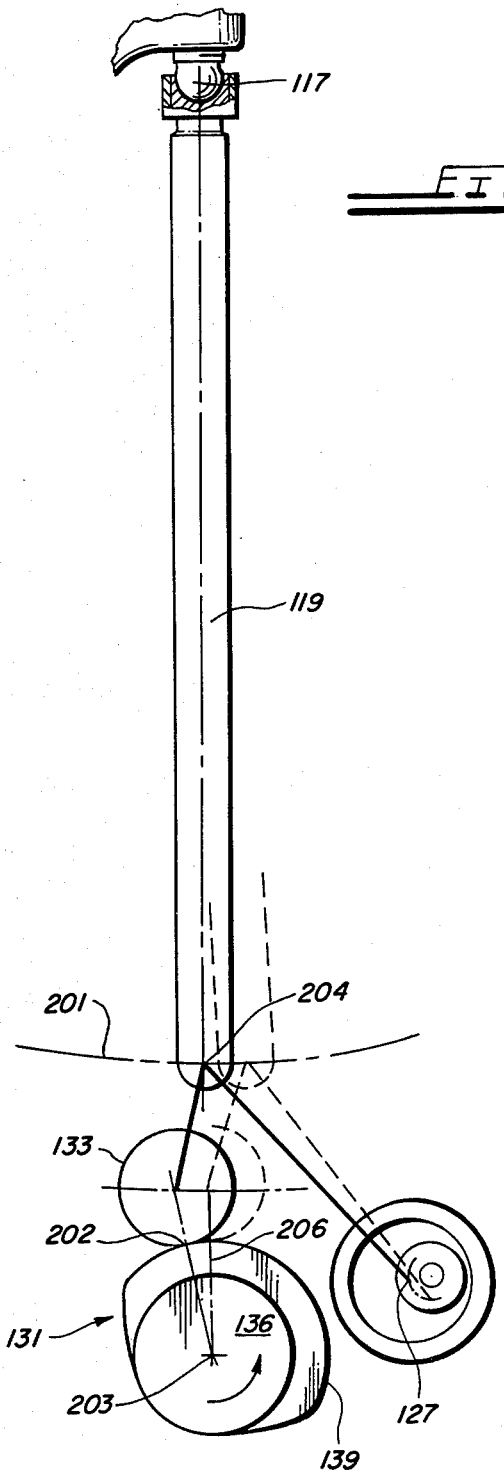
FIG. 13 is a schematic diagram illustrating the operation of the apparatus.

With reference to FIGS. 8 and 13, when the timing is adjusted by angularly moving the cam follower 122 relative to the cam 131, the lower end of the rod or link 119 moves with the cam follower, causing the rod 119 to tilt or pivot on the center of the ball 117. One would expect the ball 117 to move downwardly slightly, thus shortening the effective length of the rod 119, as the amount of tilt of the rod increases, but this does not occur in apparatus embodying this invention.

With specific reference to FIG. 13, the maximum retard position is shown in full lines and the maximum advance position is shown in dashed lines. The lower end of the push rod 119 moves on an arc 201 having its center at the center of the ball 117, during an adjustment between the retard and advance positions. FIG. 13 shows the follower roller 133 on the lobe 139, but the result is the same when the roller 133 is on the lower portion of the cam 131. Since the center of the lower end of the rod 119 is on the arc 201 regardless of the setting of timing when the follower roller 133 is on the lobe 139, the rocker arm 114 and the plunger of the injector 112 will always be in the same position at the end of an injection stroke, regardless of the setting of timing. Similarly, the injector parts will also always be in the same positions at the beginning of an injection stroke, regardless of the setting of the timing. The result is that the operating characteristics of the injector will be constant in spite of a change in timing.

The foregoing is attained by properly locating, relative to each other, the pivot axis 127, the point 202 of contact between the follower roller 133 and the cam 131, the axis 203 of the cam 131 and the center point 204 of the link or rod 119, which point 204 may be considered the point of engagement between the follower and the rod 119. The length of the rod 119 is also important since it should be quite long.

With reference to FIG. 13, the follower 133 is movable to the solid line or full retard position, the dashed line or full advance position, and to positions in between, as previously explained. When the cam follower is in one of the full positions (the full advance position in FIG. 13) the point 202 of contact between the cam and the roller is approximately on a line 206 drawn between the centers of the cam 136 and the ball 117. When the follower is moved to the other full position (the full retard position in FIG. 13) the point 202 moves away from the line 206 and it also moves away from the ball 117. One would expect the point 204 to also move downward during such movement from the dashed to the solid line position, but it is prevented from doing so because of the location of the pivot axis 127 and its movement from the dashed to the solid line positions. The axis 127 swings upwardly at the same time that the point 202 moves downwardly, and this upward movement of the axis 127 tends to move the point 204 upwardly. Consequently, when moving from the dashed to the solid line positions, the effect on the position of the point 204 caused by the downward movement of the point 202 is counterbalanced by the effect of the upward movement of the axis 127. The net effect is that the point 204 remains essentially on the arc 201 during such movement. Of course, when the parts are moved from the solid to the dashed line positions, the operation is reversed but the net result is the same.

In the construction shown in FIGS. 1 to 5, the operation is similar. When adjusting from one full position to the other full position, the point of contact between the cam 53 and the follower roller 79, for example, moves slightly toward or away from the center of the ball 38. Such movement is counterbalanced by the movement of the pivot axis 71 in order to maintain the center of the lower end of the rod 36 on an arc having the ball 38 as its center.

As a specific example of the preferred embodiment of the invention shown in FIGS. 8 to 13, the horizontal distance from the axis 126 of the rocker shaft to the axis of the cam shaft 136 is 2.44 inches, and the vertical distance between these two axes is 0.845 inch; the smaller diameter of the cam 136 is 2.50 inches; the distance from the axis 126 to the axis 127 is 0.206 inch; the distance from the axis 127 to the center of the roller 133 is 2.82 inches; the roller 133 has a diameter of 1.25 inches. When the parts are in the full advance position, the eccentric angle between a vertical line extending downwardly from the axis 126 and a line passing through the axes 126 and 127 is 78.87°, and the timing angle between a vertical line passing through the center of the cam shaft 136 and a line connecting the centers of the shaft 136 and the roller 133 is 12.0°. When the parts are in the full retard position, the eccentric and timing angles are 0.262° and 3.0°. During movement between the full advance and retard positions, the effective length of the rod 119 does not change more than 0.0006 inch. A change great enough to substantially change the seating force or load is unacceptable. The actual distance from the point 204 to the center of the ball 117 is approximately 11 inches.

It will be apparent that a novel and useful apparatus has been provided for adjusting the timing of injection. The timing may be adjusted automatically during operation of the engine. The apparatus utilizes eccentric means to adjust the timing in an infinite number of steps between the advance and retard positions, and such an eccentric means is relatively simple to construct and operate. Further, the effective length of the rods connecting the cam followers and the rocker arms remain essentially unchanged during a timing adjustment and as a result the compressive loading on the plunger and the nozzle is effectively unchanged.

What is claimed is:

1. In an internal combustion engine including at least one injector of the type that includes a cup and a plunger that engages the cup at the end of an injection stroke of the plunger during an injection cycle, a rocker arm mounted for pivotal movement and connected to actuate the injector, a rod having one end connected to pivot the rocker arm and extending toward a cam, the improvement comprising a cam follower contacting said cam and connected to the other end of said rod, said rod being tiltable on said one end thereof, and movable eccentric means for pivotably mounting said cam follower and angularly moving said follower relative to said cam and moving said other end of said rod so that at a time in an injection cycle, as for example when said plunger engages said cup, said other end of said rod moves on an arc that has as its center said one end of said rod said cam follower being angularly movable to a full advance position, to a full retard position and to positions therebetween, the point of contact of said follower with said cam being closely adjacent a line drawn from the center of said cam to said one end of said rod when said follower is in one of said positions, and said point of contact being displaced from said line and away from said other end when said follower is in the other of said positions, and said eccentric means mounts said cam follower for pivotal movement on a pivot axis, said other end of said rod, said point of contact and said pivot axis being spaced and forming points of a triangle, and said eccentric means displaces said pivot axis in a direction which is opposite the direction of displacement of said point of contact when said follower is moved between said positions, said directions of displacement being generally parallel to said line.

2. In an internal combustion engine, the improvement comprising at least one injector, the injector comprising a plunger that is movable in an injection stroke and a cup that is engaged by the plunger at the end of the injection stroke during an injection cycle, a rocker arm connected to actuate the plunger of the injector, a relatively long rod having one end connected to the rocker arm and extending toward a cam, a cam follower having a point of contact with said cam and a center of pivotal connection with the other end of said rod, said rod being tiltable on said one end thereof, and movable eccentric means for pivotably mounting said cam follower and angularly moving said follower relative to said cam and moving said center of pivotal connection with said rod so that at a time in an injection cycle, as for example when said plunger engages said cup, said center of pivotal connection moves on an arc that has as its center said one end of said rod said follower having a center of movement on said eccentric means, said point and said centers forming spaced points of a triangle, said movement of said eccentric means causing said point of contact and said center of movement to shift in substantially opposite directions toward and away from said one end of said rod and thereby moving said center of pivotal connection on said arc.

3. Apparatus as in claim 2, wherein said eccentric means is rotatable, and further including means responsive to an operating parameter of the engine for rotating said eccentric means during operation of the engine.

4. Apparatus as in claim 2, wherein said eccentric means comprises part of a rocker shaft and further including actuator means connected to said rocker shaft for turning said rocker shaft, said actuator means being adapted to be connected to an air intake manifold of the engine, thereby making the angular position of said rocker shaft responsive to the air intake manifold pressure.

5. Apparatus as in claim 2, wherein said engine includes a plurality of cylinders, an injector, a rocker arm, a rod, a cam, a cam follower, and an eccentric means being provided for each of said cylinders, all of said eccentric means being connected together for simultaneous movement.

6. Apparatus as in claim 5, wherein said engine cylinders are located in line, and said eccentric means comprises a rocker shaft and a plurality of eccentric portions formed thereon, each of said eccentric portions supporting one of said cam followers.

7. Apparatus as in claim 5, wherein said engine is a V-type and said cylinders are formed in two banks, and said eccentric means comprises a rocker shaft movably mounted in the space between the two banks, said rocker shaft having a plurality of eccentric portions formed thereon, each of said eccentric portions supporting one of said cam followers.

8. Apparatus as in claim 5, wherein said engine is a V-type and said cylinders are formed in two banks, and said eccentric means comprises two rocker shafts movably supported in the space between the two banks, each of said rocker shafts having a plurality of eccentric portions formed thereon, means connecting said rocker shafts together for simultaneous movement, each of said rocker shafts being associated with one of said banks of cylinders.

9. Apparatus as in claim 2, wherein said eccentric means comprises a rotatable rocker shaft having an eccentric portion formed thereon, said cam follower being pivotably mounted on said eccentric portion, and said eccentric portion being movable in an arc on the axis of said rocker shaft in order to adjust the position of said cam follower relative to said cam.

* * * * *